United States Patent [19]

Stefanescu et al.

[11] Patent Number: 4,501,612

[45] Date of Patent: Feb. 26, 1985

[54] COMPACTED GRAPHITE CAST IRONS IN THE IRON-CARBON-ALUMINUM SYSTEM

[75] Inventors: Doru M. Stefanescu, Tuscalosa; Freddy Martinez, University, both of Ala.

[73] Assignee: The University of Alabama, University, Ala.

[21] Appl. No.: 545,858

[22] Filed: Oct. 27, 1983

[51] Int. Cl.[3] ..... C22C 33/08

[52] U.S. Cl. ..... 75/124; 75/130 A; 75/130 R; 75/123 CB; 148/35

[58] Field of Search ..... 75/124 E, 124 F, 130 A, 75/130 R, 124 A, 123 CB; 148/35

[56] References Cited

U.S. PATENT DOCUMENTS

| | | | |
|---|---|---|---|
| 1,745,645 | 2/1930 | Sauveur | 75/123 R |
| 1,924,344 | 8/1933 | Babinet | 75/124 |
| 1,944,179 | 1/1934 | Homerberg | 75/124 |
| 3,689,255 | 9/1972 | Modl | 75/123 CB |
| 3,902,897 | 9/1975 | Sobue et al. | 148/35 |
| 3,997,338 | 12/1976 | Van Eeghem et al. | 75/124 A |
| 4,036,641 | 7/1977 | Evans et al. | 75/130 A |
| 4,246,026 | 1/1981 | Stefanescu et al. | 75/130 A |
| 4,396,428 | 8/1983 | Linebarger | 75/130 A |

FOREIGN PATENT DOCUMENTS

| | | | |
|---|---|---|---|
| 0475409 | 9/1975 | U.S.S.R. | 75/124 A |

OTHER PUBLICATIONS

"CG Iron Makes a Dramatic Improvement in the Performance of Railroad Disc Brakes," Foote CGI Report No. 4.

D. M. Stefanescu, C. R. Loper, Jr., "Recent Progress in the Compacted/Vermicular Graphite Cast Iron Field," Giesserei-Praxis, No. 5, 1981.

*Primary Examiner*—L. Dewayne Rutledge
*Assistant Examiner*—Debbie Yee
*Attorney, Agent, or Firm*—Oblon, Fisher, Spivak, McClelland & Maier

[57] ABSTRACT

A process for the production of a compacted graphite cast iron which is substantially free of carbides in castings as thin as 0.15 inches, and with nodularities of less than 20% by volume without postinoculation, which comprises adding aluminum to a compacted graphite cast iron, such that the compacted graphite cast iron consists essentially of about 0.5 to 7% by weight aluminum, about 2.5 to 4% carbon, 0 to about 1.5% silicon, with the remainder iron and inevitable impurities.

The compacted graphite cast iron produced thereby is useful in the production of castings with both thick and thin sections.

9 Claims, 2 Drawing Figures

INFLUENCE OF SILICON CONTENT ON THE MECHANICAL PROPERTIES OF IRON-CARBON-SILICON CG IRONS

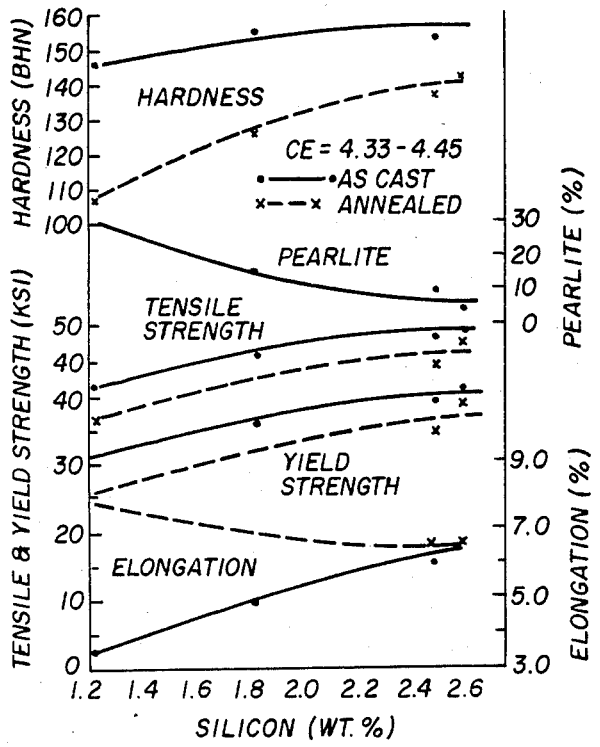
FIG. 1 INFLUENCE OF SILICON CONTENT ON THE MECHANICAL PROPERTIES OF IRON-CARBON-SILICON CG IRONS
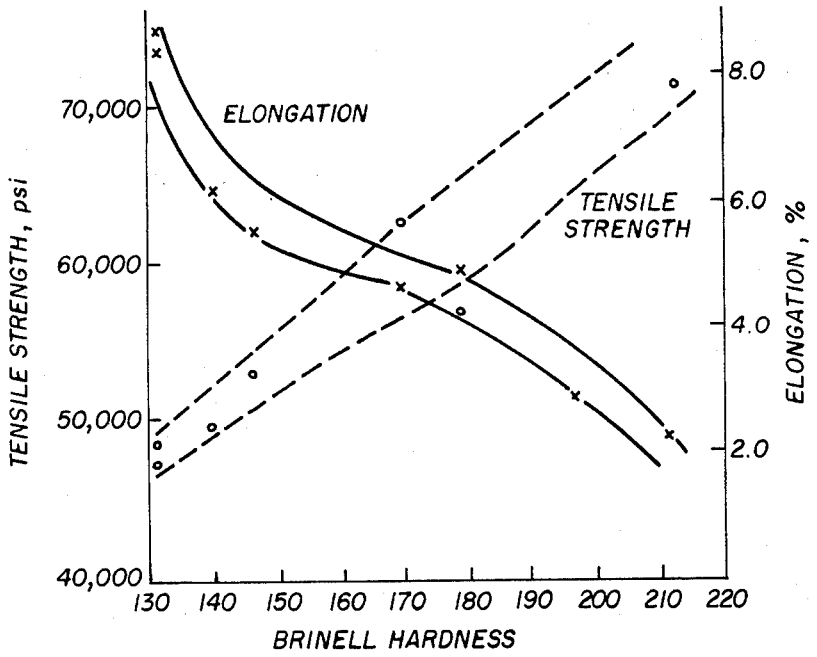
FIG. 2 CORRELATION BETWEEN MECHANICAL PROPERTIES OF IRON-CARBON-ALUMINUM CG IRONS

COMPACTED GRAPHITE CAST IRONS IN THE IRON-CARBON-ALUMINUM SYSTEM

BACKGROUND OF THE INVENTION

1. Field of the Invention

This invention relates to a process for the production of a compacted graphite cast iron containing iron, carbon and aluminum and the compacted graphite cast iron produced thereby.

2. Description of the Prior Art

Cast irons are alloys of iron and carbon, with or without other elements, usually containing 2.0 to 4.5% carbon. Where no special alloying materials are added, the final cast material is known as gray cast iron, with tensile strengths ranging from 30,000 to 45,000 psi and a Brinell hardness of 187–235. A composition representative of a gray cast iron is C, 3–3.35%; Si, 2–2.4%; S, up to 0.12%; P, up to 0.2%; and Mn, 0.6–0.7%. *Chemical and Process Technology Encyclopedia,* Iron and Steel (McGraw-Hill 1974).

The majority of cast irons have sufficient silicon (more than 1.5%) so that graphite forms during the solidification process. It is known that the presence of silicon in the cast iron facilitates the dissociation of iron carbide to iron and graphite at high temperatures. The graphite formed gives the metal a gray color on a fractured surface, hence the term gray cast iron. *Elements of Materials Science,* Graphitization Process (Addison-Wesley 1979). Moreover, the graphite is usually present as flakes within the metal. These graphite flakes reduce not only the tensile properties, but also the ductility of the cast iron. As graphite has almost no strength, the flakes act as voids within the structure and reduce the effective cross-sectional area of the casting. Also, cracks are readily propagated from flake to flake within the metal. Consequently, gray cast iron breaks without perceptible distortion due to its low ductility. Further, gray cast iron has little or no impact or shock-resistance properties. See *Marks' Standard Handbook for Mechanical Engineers,* Cast Iron, 8th Edition (McGraw-Hill 1978).

In contrast to gray cast iron, nodular cast iron, or ductile cast iron as it is also known, has a metallic structure in which the graphite occurs not in flakes but as tiny balls or spherulites. The presence of a few hundredths of a percent of Mg, Ce or rare earths introduced into the molten iron just before casting causes the spherulite graphite particles to form during solidification.

The formation of spherulite graphite particles is important as the spherical graphite particles do not produce the severe stress concentrations developed internally in gray cast iron. Therefore, much greater ductility is obtained with a nodular cast iron. Due to the lower melting temperature of nodular cast iron as opposed to steel containing no graphite, the use of nodular iron is desirable whenever a low melting temperature and moderate ductility are required. The tensile strength of nodular cast iron is usually in the range of 55,000 to 120,000 psi, and the Brinell hardness in the range of 121 to 273. *Chemical and Process Technology Encyclopedia,* id.

Compacted graphite cast iron is an iron-carbon-silicon alloy containing graphite in the form of interconnected clusters. The properties of this material are intermediate between those of gray and ductile or nodular cast iron. The correlation between some of the mechanical properties of typical compacted graphite cast irons are illustrated in FIG. 1.

In order to better define the quality of the iron, two quality indices may be used as follows:

1. The product of tensile strength and elongation (TS×El): A higher value of this product characterizes a superior iron.
2. The ratio between tensile strength and Brinell hardness (TS/HB): A higher value of this quotient characterizes a superior iron.

Using data provided by K. P. Cooper and C. R. Loper, "Some Properties of Compacted Graphite Cast Iron, AFS Transactions", Vol. 86, 1978, some typical values for the aforementioned quality indices, i.e. (TS×El and (TS/HB), were calculated for compacted graphite cast irons having various amounts of silicon. The data obtained from these calculations is shown in Table 1.

TABLE 1

Typical Mechanical Properties for Iron-Carbon-Silicon Compacted Graphite Cast Irons

| Silicon Content % | Tensile Strength 1000 psi | Elongation % | Brinell Hardness | (TS/HB) | (TS × El) |
|---|---|---|---|---|---|
| 1.2 | 42 | 3.4 | 147 | 0.29 | 143 |
| 2.6 | 47 | 6.3 | 152 | 0.31 | 296 |

Using the two quality indices described, inspection of Table 1 illustrates that the compacted graphite cast iron containing 2.6% Si is superior to that containing only 1.2% Si.

Due to the fact that the properties of compacted graphite cast iron are intermediate between those of gray cast iron and nodular or ductile cast iron, compacted graphite cast iron is used for many applications. For example, it has been used in the manufacture of ingot molds, flywheels, diesel engine castings, exhaust manifolds, gear pump housings and railroad disc brakes. See D. M. Stefanescu and C. R. Loper, "Recent Progress in the Compacted/Vermicular Graphite Cast Iron Field", Giesserei Praxis, No. 5, 1981. Also see "CG Iron Makes Dramatic Improvement in the Performance of Railroad Disc Brakes", Foote CG I Report No. 4.

However, castings having both thin and thick sections of compacted graphite cast iron have not been produced. If the chemical analysis and molten treatment are adjusted for the average section there is a risk of chilling in the thin sections (smaller than ½ inch), due to the high chilling tendency of this particular iron. If increased amounts of ferrosilicon are added in order to counterbalance this chilling tendency, in most cases, high nodularity iron will result, with subsequent losses in the basic properties of compacted graphite cast irons.

Additionally, iron-carbon-silicon compacted graphite cast irons have the disadvantage that in order to produce a pearlitic structure, heat treatment or expensive alloying with copper or tin is required.

Therefore, a need continues to exist for a method for producing compacted graphite cast iron having both thin and thick sections with a reduced amount of nodules contained therein.

SUMMARY OF THE INVENTION

Accordingly, it is an object of the present invention to provide a process for the production of compacted graphite cast iron having both thick and thin sections with a reduced amount of nodules contained therein.

It is also an object of this invention to provide a process for the production of compacted graphite cast iron having a wide variety of mechanical properties and structures.

Moreover, it is an object of the present invention to provide a process for the production of compacted graphite cast iron having both thick and thin sections having a pearlitic structure without heating treating the metal or using expensive alloying elements such as copper or tin.

According to the present invention, the foregoing and other objects are attained by providing a process for the production of a compacted graphite cast iron which is substantially free of carbides in castings as thin as 0.15 inches and with nodularities lower than 20% by volume without postinoculation which entails adding aluminum to a compacted graphite cast iron, such that the compacted graphite cast iron contains about 0.5 to 7% by weight aluminum, about 2.5 to 4% carbon, 0 to about 1.5 silicon, with the remainder iron and inevitable impurities.

BRIEF DESCRIPTION OF THE DRAWINGS

Other objects, features and attendant advantages of the present invention will be more fully appreciated as the same becomes better understood from the following detailed description when considered in connection with the accompanying drawings in which like reference characters designate like or corresponding parts throughout the several views and wherein:

FIG. 1 illustrates the influence of the silicon content on the mechanical properties of iron-carbon-silicon compacted graphite cast irons;

FIG. 2 illustrates the correlation between the mechanical properties of iron-carbon-aluminum compacted graphite cast irons.

DETAILED DESCRIPTION OF THE PREFERRED EMBODIMENTS

According to the present invention, compacted graphite cast iron castings having both thin and thick sections are produced wherein the castings are substantially free of carbides in castings as thin as 0.15 inches. Moreover, these castings are produced with nodularities lower than 20% by volume without postinoculation.

Surprisingly, it has been found that by adding aluminum to the compacted graphite cast iron, and maintaining the silicon content within a range of 0 to 1.5% by weight, it is possible to produce a compact graphite cast iron having both thin and thick sections wherein the castings are substantially free of carbides in castings as thin as 0.15 inches. Further, by using aluminum in the compacted graphite cast iron, and restricting the silicon content to the specified range, castings may be produced having lower than 20% nodularities by volume without postinoculation.

According to the present invention, aluminum is present in the compacted graphite cast iron in the amount of about 0.5 to 7% by weight. Silicon is present in the compacted graphite cast iron in the amount of 0 to about 1.5% by weight. Carbon is present in the range of about 2.5 to 4% by weight, with the remainder iron and inevitable impurities. However, it is preferable to employ aluminum in the compacted graphite cast iron in the amount of about 1 to 5.5% by weight. The weight percentages are based on the total weight of the compacted graphite cast iron. It is also preferred to maintain the silicon content in the amount of 0 to about 1% by weight.

In forming a compacted graphite cast iron using aluminum with only the specified amount of silicon, superior mechanical properties, as reflected by higher quality indices, are achieved. Some typical mechanical properties obtained using different levels of aluminum, as well as the corresponding quality indices are listed in Table 2.

TABLE 2

Typical Mechanical Properties for Iron-Carbon-Aluminum Compacted Graphite Cast Irons

| Aluminum Content % | Tensile Strength 1000 psi | Elongation % | Brinell Hardness | (TS/HB) | (TS × El) |
|---|---|---|---|---|---|
| 2.5 | 48.7 | 8.3 | 131 | 0.37 | 404 |
| 3.6 | 53.2 | 5.5 | 146 | 0.36 | 293 |
| 4.0 | 62.1 | 4.7 | 170 | 0.36 | 292 |
| 5.5 | 70.8 | 2.2 | 212 | 0.33 | 156 |

By inspection of Table 2, it can be seen that the (TS/HB) ratio varies from 0.33 to 0.37, while the product (TS×El) ranges from 156 to 404. These values are considerably higher than those indicated above for iron-carbon-silicon compacted graphite cast irons.

There are, perhaps, several reasons for the enhanced (TS×HB) and (TS×El) values. First, the strengthening effect of aluminum on ferrite is less than that of silicon. Hence, the use of aluminum according to the present invention instead of only silicon results in the production of a more ductile ferrite. Second, the pearlite containing aluminum is finer and harder than the pearlite containing only silicon.

However, there are other advantages which accrue from the use of aluminum, according to the present invention, in place of silicon in the formation of a compacted graphite cast iron. According to the process of the present invention, it is possible to produce a wide variety of mechanical properties and cast iron matrix structures in the compacted graphite cast irons formed, ranging from 100% ferrite to 100% pearlite. Such a variation can be achieved by simply varying the aluminum content of the alloy. See Table 2. This obviates the requirement of using expensive alloying elements in the production of pearlitic grades.

Further, the chilling tendency of the present iron-carbon-silicon compacted graphite cast iron is much lower than that of the conventional iron-carbon-silicon compacted graphite cast irons. Consequently, there is no need for postinoculation and sections as thin as 0.15 inches can be produced free of carbides and with nodularities lower than 20% by volume.

Moreover, at aluminum contents of greater than 3.5% by weight, a very fine interdendritic compacted form of graphite replaces the classical compacted form of graphite.

The conventional cast irons with flake (gray cast iron) or spheroidal graphite (ductile or nodular cast iron) are known to have excellent high temperature properties such as excellent short term tensile properties, oxidation resistance and growth resistance. L. Sofroni and D. M. Stefanescu, "Special Cast Irons", (in Romanian), Editura Tehnica Bucuresti (1974). It has been found that the iron-carbon-aluminum cast irons of the present invention exhibit similar excellent high temperature properties such as excellent short term tensile properties, oxidation resistance and growth resistance.

In order to obtain the compacted form of graphite, magnesium or magnesium containing alloys are added directly in the mold or in the ladle in order to result in a residual magnesium content of about 0.016 to 0.023% by weight. The graphite shape is also controlled by the aluminum incorporated in the melt. As mentioned above, at aluminum contents of about 3.5%, a very fine interdendritic compacted form of graphite replaces the compact graphite form of graphite.

It has been found that in the process of the present invention, it is preferred to add magnesium after the addition of aluminum. When magnesium and aluminum are added together, there is a tendency for both metals to form oxides. The formation of these oxides can be minimized by adding the magnesium after the addition of aluminum. To achieve this, it is possible to add the magnesium directly to the mold or ladle. Moreover, the magnesium or magnesium containing alloys may be added in solid form to the melt in the mold or ladle.

It is also within the scope of the present invention to add rare earth metals or rare earth alloys in the mold or in the ladle. These metals are used in conventional amounts.

A particular embodiment of the present invention is a compacted graphite cast iron having an aluminum content in the range of 1 to 5.5% by weight and a silicon content of not more than 1% by weight.

Another particular embodiment of the present invention is a cast iron having a very fine interdendritic compacted form of graphite which has an aluminum content of 3.5% or more by weight and 1% or less by weight of silicon.

Regardless of whether the classical compacted graphite or the very fine interdendritic compacted graphite is formed according to the present invention, a cast iron is produced which is substantially free of carbides, and which has nodularities of less than 20% by volume in the cast iron. Moreover, with either the classical or interdendritic compacted graphite, the cast iron produced according to this invention may have a cast iron matrix structure ranging from 100% ferritic to 100% pearlitic depending upon the choice of treatment parameters in accordance with well-known iron-carbon equilibrium relationships.

Moreover, if either a classical or very fine interdendritic compacted graphite cast iron is produced according to the present invention, the result is a cast iron having excellent high temperature properties and room temperature tensile properties.

It is noted that the process conditions used to prepare the compacted graphite cast iron are conventional conditions. Hence, with the information disclosed herein, the practice of the present invention is understood to be within the ability of one skilled in the art.

The present invention will be further illustrated by an Example which is provided for purposes of illustration only and is not intended to limit the present invention.

EXAMPLE 1

A heat was produced in a 50 lb. induction furnace lined with alumina starting from high purity pig iron (Sorel metal). After melt down the iron was superheated at 1580° C., transferred in a pouring ladle where 4.75% aluminum was also added (corresponding to an aluminum content of 3.94% in the product cast iron) and then poured in keel block molds at 1450° C. The keel block molds were made from no bake sand and were specially designed for testing in mold spheroidal graphite cast irons.

A total of 1.73% by weight of the casting of a 5% magnesium ferrosilicon alloy was added in the reaction chamber of the keel block mold.

Metallographic samples and samples for mechanical testing were prepared for each keel block. The structure exhibited 95% very fine interdendritic compacted graphite, 5% spheroidal graphite and no flake graphite. The ferrite content was 45% and no carbides were present in the 1 inch diameter bars.

The tensile strength of the samples was 64,796 psi, the elongation 4.5% and the Brinell hardness 179.

Obviously, many modifications and variations of the present invention are possible in light of the above teachings. It is therefore to be understood that within the scope of the appended claims, the invention may be practiced other than as specifically described.

What is claimed as new and desired to be secured by Letters Patent of the United States is:

1. A process for producing a compacted graphite cast iron which is substantially free of carbides in castings as thin as about 0.15 inches, and with nodularities of less than 20% by volume without postinoculation, which comprises adding aluminium to a compacted graphite cast iron melt, such that the compacted graphite cast iron consists essentially of about 0.5 to 7% by weight aluminum, about 2.5 to 4% carbon, 0 to about 1.5% silicon, with the remainder iron and inevitable impurities.

2. The process according to claim 1, which further comprises adding magnesium or magnesium-containing alloys directly in the mold or ladle to result in a residual magnesium content of about 0.016 to 0.023% by weight.

3. The process according to claim 1, wherein the cast iron matrix structure is controlled by the aluminum level in the cast iron, from 100% ferritic to 100% pearlitic.

4. The process according to claim 1, wherein the aluminum in said compacted graphite is present in the amount of about 1 to 5.5% by weight and said silicon content is present in the amount of about 1% by weight.

5. A compacted graphite cast iron having a cast iron matrix structure ranging from 100% ferritic to 100% pearlitic and having excellent high temperature properties, wherein said compacted graphite cast iron is substantially free of carbides and has nodularities of less than 20% by volume, which consists essentially of aluminum in the range of 0.5 to 7% by weight, silicon in the amount of 0 to about 1.5% by weight, carbon in the range of about 2.5 to 4% by weight, with the remainder iron and inevitable impurities.

6. The compacted graphite cast iron according to claim 5, wherein said aluminum content is in the range of 1 to 5.5% by weight and said silicon content is in the range of 0 to about 1% by weight.

7. A cast iron having a very fine interdendritic compacted form of graphite having a cast iron matrix structure ranging from 100% ferritic to 100% pearlitic and having excellent high temperature properties and room temperature tensile properties, wherein said cast iron is substantially free of carbides and has nodularities of less than 20% by volume, which consists essentially of about 3.5% to 7% by weight of aluminum, 0 to about 1% by weight of silicon, about 2.5 to 4% by weight carbon, with the remainder iron and inevitable impurities.

8. A compacted graphite cast iron article with some or all sections thereof having a thickness of about 0.15 inches or greater, being substantially free of carbides and having nodularities of less than 20% by volume, which consists essentially of aluminum in the range of 0.5 to 7% by weight, silicon in the amount of 0 to about 1.5% by weight, carbon in the amount of about 2.5 to 4% by weight, with the remainder iron and inevitable impurities.

9. The compacted graphite cast iron article according to claim 8, wherein the aluminum content is in the range of 1 to 5.5% by weight and said silicon content is 0 to about 1% by weight.

* * * * *